US005511789A

United States Patent [19]

Nakamura

[11] Patent Number: 5,511,789

[45] Date of Patent: Apr. 30, 1996

[54] GOLF SWING TRAINING DEVICE

[76] Inventor: Yoshikazu Nakamura, 4-25, Kamigasa 1-Chome, Kusatsu-Shi, Shiga 525, Japan

[21] Appl. No.: 313,116

[22] PCT Filed: Feb. 14, 1994

[86] PCT No.: PCT/JP94/00219

§ 371 Date: Jan. 4, 1995

§ 102(e) Date: Jan. 4, 1995

[87] PCT Pub. No.: WO94/19070

PCT Pub. Date: Sep. 1, 1994

[30] Foreign Application Priority Data

Feb. 16, 1993 [JP] Japan ..... 5-051430
Dec. 23, 1993 [JP] Japan ..... 5-347842

[51] Int. Cl.[6] ..... A63B 69/36

[52] U.S. Cl. ..... 473/202; 473/209; 473/213; 473/215

[58] Field of Search ..... 273/187.2, 187.5, 273/188 A, 186.2; 434/252

[56] References Cited

U.S. PATENT DOCUMENTS 3,138,388 6/1964 Herold ..... 273/187.2
3,717,857 2/1973 Evans ..... 273/187.2
4,637,612 1/1987 Wilkins ..... 273/187.2
4,930,785 6/1990 Mills ..... 273/187.5
5,375,842 12/1994 Plottner ..... 273/187.2

FOREIGN PATENT DOCUMENTS 53-30367 7/1978 Japan .
60-949 1/1985 Japan .
61-136771 8/1986 Japan .
61-179176 8/1986 Japan .

*Primary Examiner*—George J. Marlo
*Attorney, Agent, or Firm*—Armstrong, Westerman, Hattori, McLeland & Naughton

[57] ABSTRACT

When the golfer makes the most important part of the golf swing, i.e., from the back swing to the down swing, most of the movements of swing check points after the top naturally become good by performing an ideal body turn of lower body lead. It is intended to permit such an ideal body turn to be mastered, eliminate a commonly termed hand shooting from the top, increase the head speed without irrational force to increase the distance, improve the shot control and produce high level swing form. To realize these intents, a golf swing training device 10 was constructed with detecting means 12 for detecting the contact of the golfer's shoulder with the chin or close contact of the former to the latter at the time of the back swing, and notifying means 20 for providing a detection signal to the golfer 18 via a controller 16, and transmitting means 22 and 24 for transmitting to the waist or knee. Further, second detecting means are provided, if necessary.

10 Claims, 7 Drawing Sheets

GOLF SWING TRAINING DEVICE

FIELD OF THE INVENTION

This invention relates to golf swing training devices and, more particularly, to a golf swing training device, with which a golf swing technique is to be acquired by people aiming at single figure level handicap or persons who want to be professional golfers.

BACKGROUND OF THE INVENTION

There is a slight difference in golf swing techniques between instructors. It is said that there are 100 or more (or 500 or more) swing check points. However, when these check points are arranged and classified, they are reduced to several basic check points. Examples of such basic check points are to correctly grip the club and take a correct stance, not to make a head-up, not to move the head, not to open the armpits, not to impact the ball by using the hands or arms from the top, i.e., make a swing by twisting the body about the backbone by using muscles of the body, that is, taking a right hand golfer as an example, shift the weight from the right foot to the left foot, etc.

While there are a large number of golf swing check points as noted above, it is impossible to make a swing while checking all these points in a short swing time of a couple of seconds. However, by mastering check points which are thought to be most important, ideal movements are acquired to obtain naturally good movements which satisfy most of the other check points as well.

These check points have to be mastered as a basic technique. However, it is impossible to visually confirm the swing form. Therefore, the swing form is liable to be deviated to result in score-down. Further, even when the training person has become able to swing the golf club after mastering the above check points, he or she may not be able to provide a sufficient distance in a long hole or may produce a misshot so that he or she can not improve the score. Particularly, woman golfers and like persons who are not so tall or persons who do not have much muscles can not produce long distance. Inevitably, they try to increase the distance and therefore forget making the proper golf swing. For instance, they often swing the golf club with the arms or hands from the top, thus resulting in misshots or swing form deviation and making the golf play more difficult.

In order that even a person who is not so tall and does not have much physical power be able to hit the ball for a long distance by increasing the head speed, make a high level golf swing to cause the ball to fly along a steady orbit and maintain handicap between zero and single figure, the inventor endeavored to improve the golfer's own swing form, studied by comparing the swing forms of famous home and foreign professional golfers and by comparing methods of improving golf play recommended by professional golfers.

As a result, the inventor found that the methods of improving golf play recommended by the professional golfers involve what are thought to be secret as know-how. But as a result of detailed analysis of video tapes and continuous pictures showing swing forms of professional golfers, it has been found that there is a substantially common swing. The content of the swing is that at the turn-over from the top the upper and lower bodies are moving in opposite directions concurrently although for a very short period of time. This golf swing was exercised repeatedly, and extremely good results could be obtained with stability of the swing form.

The golf swing that has been found will now be described in greater detail. A right hand golfer will be taken as an example. First, when the golfer gets into the back swing from the address, the body is twisted clockwise about the backbone. When the golfer's left shoulder is brought into contact with the left side of the chin, that is, at a 80 to 90% back swing position or slightly before the top, the golfer intuitively begins to cause simultaneous sliding of the left knee and the left waist by several centimeters in the flying direction for down-swinging. As a result, a time difference is produced, and the lower body turns to be rotated counterclockwise while effecting a sliding for several centimeters toward the target, while the upper body continues to be rotated clockwise due to the momentum toward the top position. Thus, for a very short moment the upper and lower bodies are moved in the opposite directions so that the body is twisted greatly. When the upper body being rotated clockwise is pulled with the lead of the lower body and stopped, it turns to be rotated counterclockwise with the body muscles as a spring and under the principles of twisting and lever, thus getting into the down swing. The down swing is brought about from the body turn swing with the body muscles with the lead of the lower body. A high head speed thus can be obtained for ball impact. When the golfer subsequently gets into the follow-through, if the state of contact between the right shoulder and the right side of the chin with each other can be confirmed, it means that a good swing without head-up could be obtained.

As shown above, the ideal and desirable golf swing is a commonly termed down swing with the lead of the lower body, in which the golfer, having gotten into the back swing from the address and reaching the top, turns to go to the down swing by twisting the lower body, i.e., waist and legs, in the direction of the down swing. If the golfer can make such a down swing with the lead of the lower body, a good swing, and hence a good shot, can be obtained. However, most of the golfer's misshots stem from the commonly termed hand swing, i.e., down swing with the lead of the upper body, in the turn-over from the top.

The down swing with the lead of the lower body can be realized by the intuitive play of the golfer himself or herself. In many actual cases, however, the golfer can not recognize by himself or herself whether he or she is in the state of the down swing with the lead of the lower body or the state of the hand swing. Therefore, it is inevitable to let an adviser watch the swing form and receive advices. However, it is impossible to receive advices from an adviser at all times.

Accordingly, researches and investigations were conducted about the method of making the hand swing difficult and permitting stable down swing with the lead of the lower body. As a result, it was found that as the back swing is gradually accelerated toward the top to produce a maximum speed near the top, that is, by increasing the momentum toward the top, the shaft flexes to make it difficult to use the hands or arms, thus permitting the ideal swing with the lead of the lower body while it is tried to make a hand swing. The inventor conducted extensive researches and investigations with an aim of permitting one to master such a golf swing and, as a result, could provide a golf swing training device according to the invention. Professional golfers say that 80% of whether a shot is good or not is determined by the back swing. However, there is no one who says such know-how or secret as what back swing is effective for obtaining the golf club shaft flexing at the top. Further, there is no one who says that such a swing permits maximum merits to be obtained.

Accordingly, the invention conducted extensive researches and investigations with an aim of permitting one to master such an ideal swing and, as a result, could provide a golf swing training device according to the invention. Prior to the filing of the present application, the inventor made a survey of prior arts using a computer but could not find out any invention which seemed to appertain the present invention.

DISCLOSURE OF THE INVENTION

A subject matter of the golf swing training device according to the invention resides in that it comprises detecting means for detecting that a shoulder of a golfer is in contact with or closest to the chin when the golfer has gotten into the back swing from the address position, and notifying means for notifying the contact or closest approach detected by the detecting means to the golfer via a controller. Such a golf swing training device may further comprise transmitting means for transmitting the contact or closest approach detected by the detecting means to the golfer's knee and/or waist on the side of the pivoting foot after weight shift.

A further subject matter of the golf swing training device according to the invention resides in that it comprises momentum detecting means mounted on a golfer's arm or the golf club or at least either one of the contact portions of the golfer's hand or fingers and the golf club for detecting a change in the momentum slightly before the golfer reaches the top at the time of the back swing, and notifying means for notifying a change in the momentum detected by the momentum detecting means to the golfer via a controller. Such a golf swing training device may further comprise transmitting means for transmitting a change in the momentum detected by the detecting means to the golfer's knee or waist on the side of the pivoting foot after weight shift.

A still further subject matter of the golf swing training device according to the invention resides in that it comprises second detecting means for detecting that the golfer's other shoulder is in contact with or closest to the chin when the golfer has gotten into the follow-through after the down swing, and notifying means for notifying the contact or closest approach detected by the second detecting means to the golfer via a controller.

A yet further subject matter of the golf swing training device according to the invention resides in that it comprises detecting means for detecting the contact of a golfer's shoulder with the chin or closest approach of the former to the latter when the golfer has gotten into the back swing from the address position, and transmitting means for transmitting the contact or closest approach detected by the detecting means to the golfer's knee and/or waist on the side of the pivoting foot after weight shift via a controller.

A yet further subject matter of the golf swing training device according to the invention resides in that it comprises momentum detecting means mounted on a golfer's arm or the golf club or at least either one of the contact portions of the golfer's hand or fingers and the golf club for detecting a change in the momentum before the golfer reaches the top at the time of the back swing, and transmitting means for transmitting a change in the momentum detected by the momentum detecting means to the golfer's knee and/or waist on the side of the pivoting foot after weight shift.

A yet another subject matter of the golf swing training device according to the invention resides in that it comprises second detecting means mounted on the golfer's arm or the golf club for detecting the momentum at the time of the back swing or the momentum from the down swing to the follow-through, behavior detecting means mounted on the golfer's knee and/or waist on the side of the pivoting foot after weight shift for detecting a movement of the knee and/or waist, and judging means for judging a timing according to the detection signal of the second momentum detecting means and behavior detecting means.

A further subject matter of the golf swing training device according to the invention resides in that it comprises detecting means mounted on at least either one of the golfer's hand and upper body and the golf club for detecting the movement of the mounting spot while a swing is made at least from the address position through the back swing to the top, and notifying means for notifying a change in the movement detected by the detecting means to the golfer.

A further subject matter of the golf swing training device according to the invention resides in that it comprises detecting means mounted on at last either one of the golfer's hand and upper body and the golf club for detecting the movement of the mounting spot, storage means for continuously and intermittently storing the movement detected by the detecting means, and display means for reproducing and displaying the movement stored in the storage means.

In such a golf swing training device, the movement of the hands, arms or golf club detected by the detecting means is at least either one of speed, acceleration, momentum and centrifugal force.

A further subject matter of the golf swing training device according to the invention resides in that it comprises pressure detecting means provided on at least either one of contact portions of the golfer's thumb and the golf club grip in contact with the thumb for detecting the pressure between the thumb and the contact portion, and notifying means for notifying the pressure detected by the pressure detecting means to the golfer. Such a golf swing training device further comprises pressure detecting means provided on at least either one of contact portions of the golfer's thumb and the golf club grip in contact with the thumb for detecting the pressure between the thumb and the contact portion, and transmitting means for transmitting the pressure, when detected by the pressure detecting means, to the golfer's knee and/or waist on the side of the pivoting foot after weight shift.

Among the golf swing training devices having the constructions described above according to the invention, the one in the typical mode comprises at least detecting means and notifying means for notifying the detected content to the golfer via a controller. The golfer is informed by the notifying means at the time of the back swing that the shoulder is in contact with or closest to the chin. In response to this information, the golfer can intuitively and immediately can slide the waist and knee on the side of the pivoting foot for several centimeters in the flying direction of the ball and then cause rotation. Thus, the turn-over from the top to the down swing, which is most important in the golf swing, can be obtained as an ideal body turn to increase the head speed, and it becomes difficult to use the hands or arms for the down swing. It thus becomes difficult to make a commonly termed hand swing. Further, the backbone as an axis of rotation is made difficult to vibrate, and at the time of the start of the down swing, both of the armpits are closed naturally. Consequently, the club passes by the vicinity of the body, and the shot control (or directivity) is thus improved, thus greatly reducing misshots. Further, the club can be sharply swung through, and the weight is naturally shifted to the left foot by being pulled by the momentum of the club. Besides, a swing with the lead of the lower body can be obtained to obtain a late hit with a delay of the club head. Further, the club head hits the ball fast, and the club thus passes through before the head-up. The finish is thus determined naturally, so that it is possible to watch the hit ball continuously.

In such a golf swing training device, the above operation may be made perfectly by providing transmitting means, which transmits a timing of causing the sliding of the waist and/or knee in the flying direction of the ball and then causing the turning for starting the down swing from the back swing. For making the above operation further perfect the golf swing training device further comprises second detecting means, which permits the confirmation of the final swing form in the operation from the down swing through the impact and follow-through to the finish.

In lieu of the detecting means, momentum detecting means may be mounted on the inner side of a golfer's thumb. At the time of the back swing, immediately before the golf club reaches the top, i.e., at a position corresponding to about 80 to 90% of the back swing, the momentum detecting means detects the changes in the weight and momentum of the golf club. According to a detection signal thus produced, the notifying means informs the golfer of the content via the controller. According to the signal, the golfer can intuitively and immediately cause the sliding of the waist and knee on the side of the pivoting foot after the weight shift in the flying direction of the ball for several centimeters and then turning the waist and knee. Then, similar action is made. Further, by providing the second momentum detecting means and behavior detecting means it is possible to permit the correction and confirmation of timing and swing form with additional information of the golfer's movement as well. It is thus possible to make the above operation further perfect.

Another golf swing training device according to the invention comprises at least detecting means and notifying means for informing the golfer of the detected content via a controller. The detecting means is mounted on the golfer's hand or arm or on the golf club and detects the golfer's swing behavior of getting into the back swing from the address and reaching the top. The behavior is detected as a motion, for instance, speed, acceleration, momentum or centrifugal force. The golfer can be informed of the changes of the motion by the notifying means via the controller. Specifically, the motion of the golfer's hands or arms in the back swing is ideally such that the speed is gradually increased from the address to the top and becomes maximum near the top to cause the flexing of the shaft. Such speed is detected either directly or as acceleration, momentum or centrifugal force. The notifying means informs the golfer of the detected value as speech, words, flute sound, etc. The golfer himself or herself thus can directly confirm that the speed is gradually increasing in the back swing or that the speed is maximum near the top.

Further, the movement of the golfer's hand or arm or the golf club in the back swing as detected by the detecting means may be stored in storage means and displayed as an image or the like on a display capable of the reproduction and display of image, thus permitting the confirmation of the movement.

Further, pressure detecting means for detecting the pressure between the thumb and a contact portion of the golf club grip in contact with the thumb, is provided on at least either one of the thumb and the contact portion, and notifying means is provided for informing the golfer of the pressure detected by the pressure detecting means. The notifying means thus call inform the golfer of reaching the top position by the golf club in the back swing by speech or the like. It is thus possible to permit clearer confirmation as to whether the motion of the golfer's hands, arms or the golf club in the back swing is at the maximum speed near the top. In addition, it is possible to inform the player of the timing of start of the down swing with the lead of the lower body. That is, the reaching of the top position by the golf club may be informed to the golfer by speech or the like, so that the golfer may intuitively and immediately cause sliding of the waist and knee on the side of the pivoting foot after the weight shift in the flying direction of the ball by several centimeters and then cause turning of the waist and knee. Thus, similar to the case described above, it is possible to produce an ideal swing.

Further, in such a golf swing training device the above operation may be made more perfectly by providing transmitting means for transmitting a timing of causing the sliding of the golfer's waist and knee in the flying direction of the ball and then causing the turning of the waist and knee for starting the back swing from the down swing.

In the construction and function of the golf swing training device according to the invention as described above, the golf swing training device according to the invention comprises at least detecting means for detecting that a golfer's shoulder is in contact with or closest to the chin after the golfer has gotten into the back swing from the address, and notifying means for informing the golfer of the detected content via a controller. The golfer thus can be informed by the notifying means of the detection by the detecting means that the golfer's shoulder is in contact with or closest to the chin in the back swing, and in response to this information the golfer intuitively and immediately cause slight sliding of the waist and knee on the side of the pivoting foot after the weight shift and subsequent turning of the waist and knee. Thus, the turn-over to the down swing from the top which is most important in the golf swing, can be obtained as an ideal body turn with the lead of the lower body, and it is made difficult to use the hands and arms in the down swing, that is, it is made difficult to make a commonly termed hand swing.

A further golf swing training device according to the invention comprises at least detecting means mounted on at least one of the golfer's hand, arm and upper body and the golf club for detecting the movement of the mounting spot while the golfer having gotten into the back swing from the address reaches the top, and notifying means for informing the golfer of the detected content via a controller. The detecting means thus detects the movement of the golf club during the back swing, and the golfer is directly informed of the movement. The golfer thus can make a check at all times as to whether the produced back swing is ideal without relying on any observation or advice of any adviser. It is thus possible to master a stable and right swing. Further, when the ideal back swing is made, the shaft flexes at the top, thus making it difficult to use the hand or arm in the down swing. Thus, the turn-over to the down swing from the top which is most important in the golf swing, can be produced by an ideal body turn with the lead of the lower body, thus making it difficult to make a hand swing.

Thus, in either case both armpits are closed naturally at the time of the down swing, and consequently the club passes by the vicinity of the body. The shot control (or directivity) thus can be improved to greatly reduce misshots. Further, the club can be swung through sharply, and the weight is naturally shifted to the left foot by being pulled by the momentum of the club. Besides, it is possible to obtain a swing with the lead of the lower body and thus a late hit with a delay of the club head. Further, since the club head hits the ball fast, it passes through before the head-up. The finish thus is determined naturally, and the golfer can watch the hit ball continuously. Further, the golf club head speed can be increased to increase the flying distance covered by the ball. Further, even if the ball lie is somewhat inferior, the ball can be caught satisfactorily because the club head comes down with a delay.

Further, with the golf swing training device according to the invention, the swing may be made with the same sense with any club from the approach to the driver, and there is no need of changing the swing form depending on the club used. The swing form thus can be stabilized.

BEST MODES OF CARRYING OUT THE INVENTION

Now, embodiments of the golf swing training device according to the invention will be described with reference to the drawings. For the sake of convenience of the description, the description will be made in connection with the right hand golfer.

Figure 1:
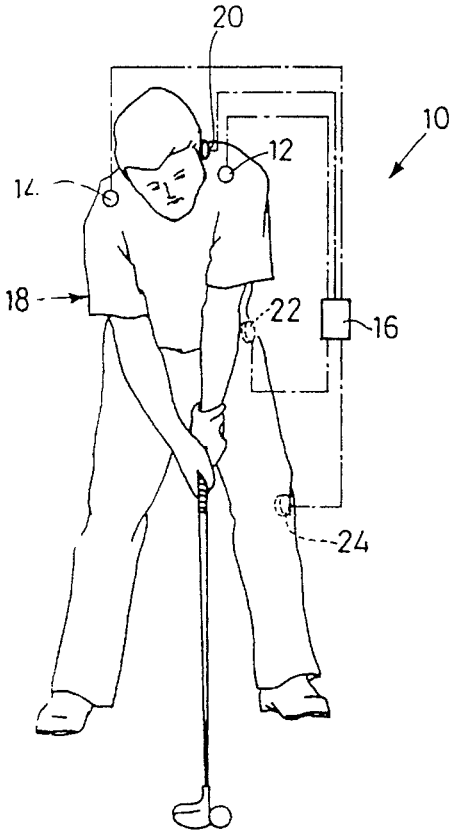
FIG. 1 is a view showing a structure of the golf swing training device according to the invention.

FIG. 1 shows a golf swing training device 10 according to the invention. As shown, the device 10 comprises detecting means 12 mounted on the golfer's left shoulder at a predetermined position thereof, second detecting means 14 mounted on the right shoulder at a predetermined position thereof, an earphone (notifying means) 20 for informing the golfer 18 of the detection by the detecting means 12 or second detecting means 14 via a controller 16, to-waist transmitting means 22 for transmitting the detection to the waist of the golfer 18, and to-knee transmitting means 24 for transmitting the detection to the knee of the golfer 18.

Figure 2:
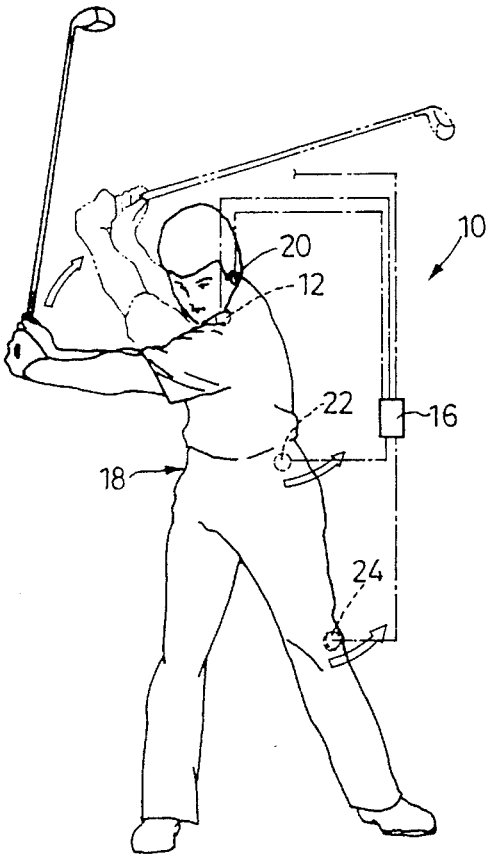
FIG. 2 is a view for explaining the operation of the golf swing training device shown in FIG. 1.
Figure 3:
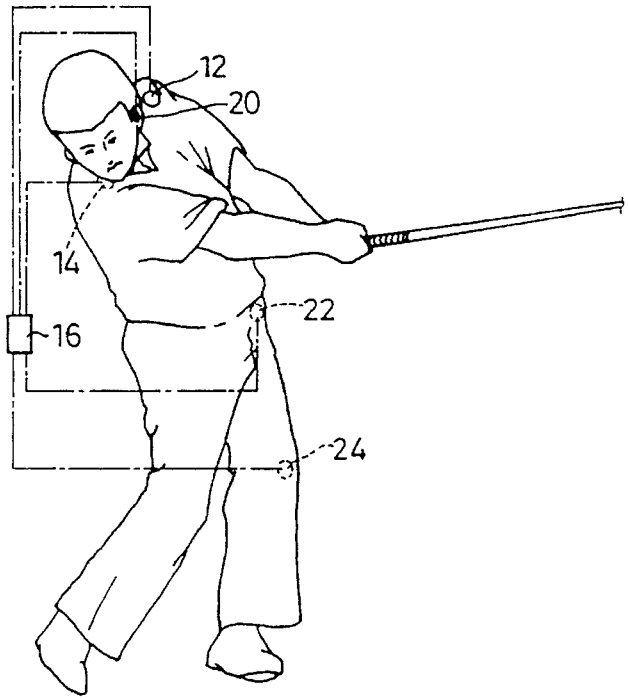
FIG. 3 is a view for explaining a continuation of the operation of the golf swing training device shown in FIG. 1.

The detecting means 12 and second detecting means 14 detect that the left shoulder is in contact with or closest to the left side of the chin or that the right shoulder is in contact with or closest to the right side of the chin when the golfer 18 makes a back swing as shown in FIG. 2 or he or she makes a follow-through after the impact as shown in FIG. 3. As the detecting means 12 or second detecting means 14 may be used pressure-sensitive sensors, pressure sensors, etc. providing changes in pressure or current according to the pressure between the shoulder and the chin, optical sensors for detecting dark field of vision generated by the contact between the shoulder and chin, temperature sensors for detecting the body temperature, other touch sensors, and further magnetic sensors for detecting that the shoulder is brought to be closest to the chin in case when the two are not brought into contact with each other. Further, it is possible to use such switching elements as push button switches and pressure switches. Furthermore, it is possible to use any other element without any limitation. The detecting means 12 and second detecting means 14 may not only be mounted on the left or right shoulder at a predetermined position thereof, but may also be mounted on the left or right side of the chin.

The earphone 20, to-waist transmitting means 22 and to-knee transmitting means 24 inform the golfer 18 of the contact or closest approach detected by the detecting means 12 or second detecting means 14 via a controller 16. Specifically, when the contact or closest approach is detected by the detecting means 12 at the time of the back swing, the earphone 20 produces a sound indicative of the contact or the like or such operation instruction speech or message as "Start from the lower body.", "Left waist", "Left knee", "Start from the left waist", etc. Concurrently or with a predetermined time difference, a detection signal is supplied via the controller 16 to the to-waist and to-knee transmitting means 22 and 24. As a result, the to-waist and to-knee transmitting means 22 and 24 transmit signals to the waist and the knee to urge operations of moving the waists and knees. The signals transmitted from the to-waist and to-knee transmitting means 22 and 24 may be weak currents, mechanical vibrations, sound waves, etc.

Particularly, it is possible to use therapy equipment used for massage or like purposes. When the contact or closest approach is detected by the second detecting means 14 at the time of the follow-through, the earphone 20 produces a sound indicative of the contact or the like or a speech or message indicative of good swing form, for instance "Swing O.K.", "Good swing", "O.K.", "Perfect", etc.

With the golf swing training device 10 having the structure as described above, as shown in FIG. 1, the detecting means 12 and second detecting means 14 are mounted on the shoulders at predetermined positions thereof, the earphone 20 is mounted on an ear, the to-waist and to-knee transmitting means 22 and 24 are mounted on the left waist and left knee, respectively, and the controller 16 is mounted around the waist by means of a belt or the like. In this way, the preparations are completed. Then, the golfer 18 having the golf club gets into a back swing from the address and twists the body about the backbone in the clockwise direction. As a result, the left shoulder is brought into contact with the left side of the chin. At this time, the detecting means 12 detects the contact of the left shoulder with the chin and causes the earphone 20 to inform the golfer 18 of the contact by sound or speech, while also causing the to-waist and to-knee transmitting means 22 and 24 to transmit the start of operation of the waist and knees. Consequently, with a predetermined time difference and by a reflex, the golfer 18 intuitively and substantially simultaneously slides the left waist and left knee in the flying direction of the ball and begins turning the waist and knees in the counterclockwise direction for the down swing.

As a result, the lower body is caused to slide toward the target by several centimeters and begins to be twisted in the counterclockwise direction. At this time, the upper body is continuing to be twisted by the momentum in the clockwise direction toward the top position. The body is thus greatly twisted. After the clockwise twisting of the upper body has been stopped by the pull of the lead of the lower body, the golfer begins to be twisted in the counterclockwise direction with the muscles of the body as a spring and under the principles of the lever, thus getting into the down swing. By making this body turn swing, the golfer effects the down swing with the muscles of the body so that he or she can obtain a high head speed to hit the ball.

Then, as shown in FIG. 3, the golfer gets into the follow-through and confirms a good swing with the right shoulder brought into contact with the right side of the chin. Subsequently, the weight is pulled by the momentum of the club and naturally shifted to the left foot, and in this way the finish is determined. At this time, the second detecting means 14 detects that the right shoulder is in contact with the chin, and causes the earphone 20 to inform that the swing form was right.

The positions of mounting the detecting means 12 and second detecting means 14 may be set adequately depending on each golfer 18. Thus, when the detecting means 12 fails to detect the contact or closest approach of the left shoulder with or to the chin at the time of the back swing and causes generation of no sound, it is possible to confirm bad points of the swing form such as an insufficient back swing or rising of the chin. Further, when the second detecting means 14 fails to detect the contact or closest approach of the right shoulder with or to the chin and causes generation of no sound at the time of the follow-through, it is possible to confirm bad points of the swing form such as the head-up.

In the golf swing training device 10 according to the invention, it is not necessarily required to use all of the detecting means 12, second detecting means 14, controller 16, earphone 20 and to-waist and to-knee transmitting means 22 and 24. Depending on the extent of the swing level acquired as a result of the training, these components may suitably be removed one after another. For example, when the golfer now can move the waist and knees at the same time, either to-waist or to-knee transmitting means 22 or 24 may be removed. Eventually, both means may be removed. Further, when the golfer no longer makes head-up at the time of the follow-through, the second detecting means 14 is no longer necessary and may suitably be removed.

Thus, the golf swing training device 10 according to the invention eventually sufficiently be such that the detecting means 12 detects the contact or closest approach of the left shoulder with or to the chin and thus causes the earphone 20 to inform the timing of moving the waist and knees via the controller 16. When the timing has been mastered after repeated exercises, the golfer now may make training without the golf swing training device 10 and may exercise actual golfing in the course. When the timing is getting out of order again, the training may be made again with the golf swing training device 10.

While a preferred embodiment of the golf swing training device has been described above, it is by no means limitative to the above embodiment.

For example, while the above embodiment used the earphone 20 as the notifying means, it is of course possible to use a headphone in place of the earphone 20. Further, a small-size loudspeaker for generating sound or speech may be provided in the detecting means 12, second detecting means 14 or controller 16.

Another embodiment of the golf swing training device according to the invention 10 comprises detecting means 12, and/or to-waist or to-knee transmitting means 22 and/or 24 for transmitting the content that the left shoulder is brought into contact with or to the closest position to the chin, as detected by the detector 12, to the waist and/or knee via the controller 16. In this embodiment, the golfer 18 suitably detect, from the sense of contact of the left shoulder and the chin with each other, the timing of causing the left waist and the left knee to slide several centimeters in the flying direction of the ball and then turn for starting the down swing. Further, it is possible to permit the timing to be detected with either one or both of the to-waist and to-knee transmitting means 22 and 24.

A further golf swing training device according to the invention has an object of permitting the proper body turn to be mastered by causing the left waist and the left knee to slide several centimeters in the flying direction of the ball and then being to turn at a predetermined position right before reaching the top by the golf club at the time of the back swing, and it may have any structure as long as such an object can be attained.

Figure 4:
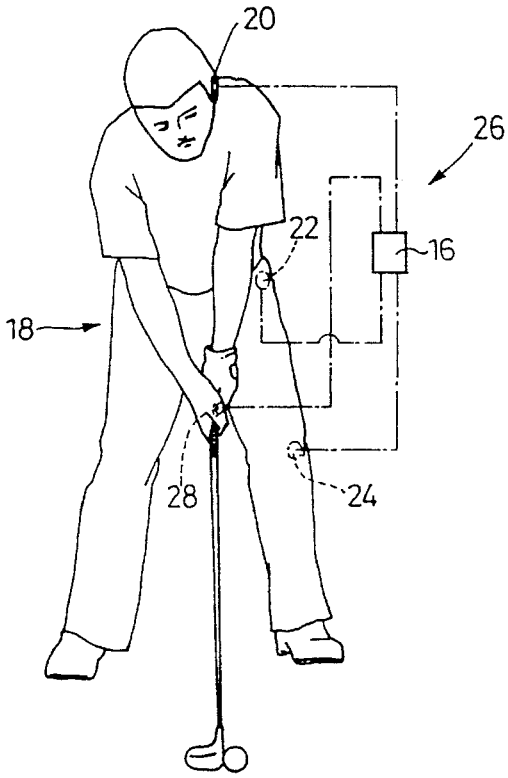
FIG. 4 is a view showing a different structure of the golf swing training device according to the invention.

FIG. 4 shows an example of such golf swing training device 26. As shown, the device comprises at least momentum detecting means 28 for detecting a change in momentum right before reaching the top at the time of the back swing, an earphone (notifying means) 20 for informing the golfer 18 of the momentum change detected by the momentum detecting means 28 via a controller 16, and to-waist and to-knee transmitting means 22 and 24 for transmitting the timing of causing the waist and knees to slide in the flying direction of the ball and turn.

Figure 5:
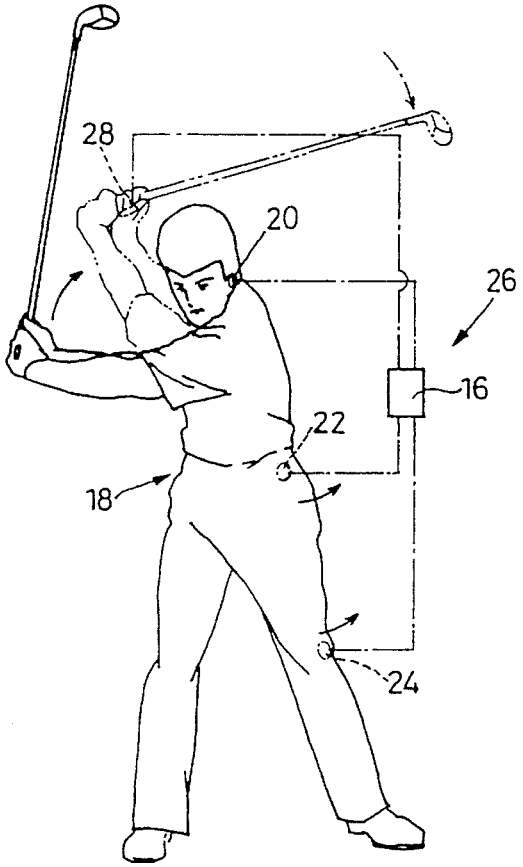
FIG. 5 is a view for explaining the operation of the golf swing training device shown in FIG. 4.

As shown in FIG. 5, in the motion at the time of the back swing from a position right before reaching the top by the golf club (i.e., a position of about 80 to 90% back swing), i.e., a position the left shoulder is brought into contact with the chin with twisting the body, till the stop of the golf club, the momentum is changed greatly. The momentum detecting means 28 detects this momentum change. So long as it can detect the momentum change, it may be mounted on any position, for instance an arm of the golfer 18 or the golf club. Particularly, it is suitably mounted on the contact portions of the inner side of the hand or fingers of the golfer 18 and the golf club, preferably on the inner side of the left thumb.

With the golf swing training device 26 of such structure, as shown in FIG. 4, the momentum detecting means 28 is mounted on the inner side of the left thumb, the earphone 20 is mounted on an ear, the to-waist and to-knee transmitting means 22 and 24 are mounted on the left waist and the left knee, respectively, and the controller 16 is mounted around the waist by means of a belt or the like. In this way, the preparations are completed. Then, as shown in FIG. 5, the golfer 18 with the golf club gets into the back swing from the address and twists the body about the backbone in the clockwise direction. At about a position, at which the left shoulder is brought into contact with the left side of the chin (i.e., a position corresponding to about 80 to 90% back swing), the twisting of the body is stopped, while the golf club is going to be turned. As a result, the momentum detecting means 28 which is disposed on the inner side of the left thumb is greatly pressurized and thus detects changes in the weight and momentum of the golf club.

Thus, the momentum detecting means 28 detects the approach of the top position by the golf club and causes the earphone 20 to inform the golfer 18 by sound or speech the contact and also cause the to-waist and to-knee transmitting means 22 and 24 to transmit an operation start instruction to the waist and the knee. Thus, with a predetermined time difference and by a reflex the golfer 18 intuitively causes the left waist and the left knee to substantially and simultaneously slide in the flying direction of the ball and begin to turn in the counterclockwise direction for the down swing. Thus, as described above, a down swing of an ideal body turn can be obtained, a high head speed can be obtained, and the ball can be hit accurately.

Again in this embodiment of the golf swing training device 26, like the previous embodiment, it is possible to mount the second detecting means 14 on the right shoulder when using the device. Further, depending on the swing level acquired by the exercise, it is possible to remove either or both of the to-waist and to-knee transmitting means 22 and 24 and use only the momentum detecting means 22, controller 16 and earphone 20 for the training.

Figure 6:
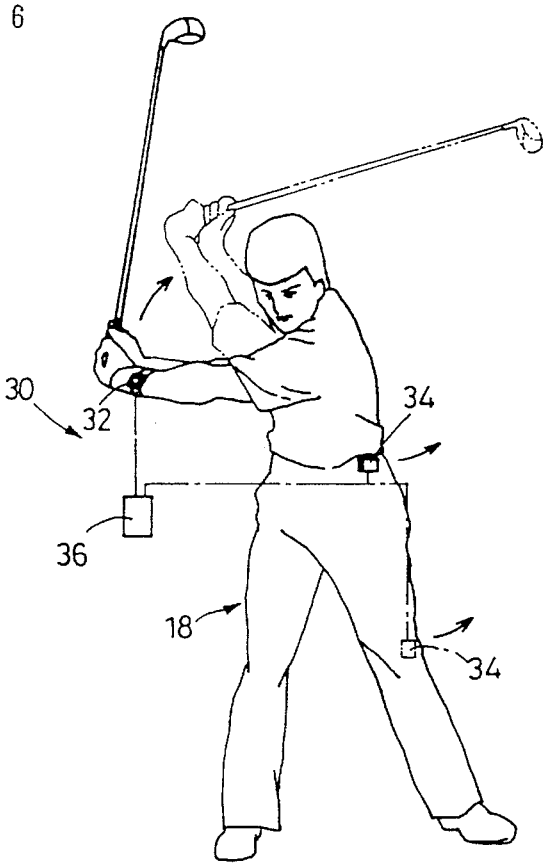
FIGS. 6 and 7 are views showing further structures of the golf swing training structure according to the invention.

FIG. 6 shows a further golf swing training device 30 according to the invention. As shown, the device comprises second momentum detecting means 32 mounted on such place as the golfer 18's left wrist or the golf club, behavior detecting means 34 mounted on the golfer's left knee or left waist, and judging means 36 for judging the result of detection by the second momentum detecting means 32 and behavior detecting means 34. The second momentum detecting means 32 detects the motion of the left hand, i.e., the motion of the golf club. For instance, by assuming the momentum at the time of the back swing to be negative and the momentum from the down swing to the follow-through to be positive, the motion of the golf club can be judged from the judgment as to whether the momentum is positive or negative. The behavior detecting means 34 checks, by utilizing the momentum or the like, whether the left knee or the left waist has been moved from the stationary state in the direction of turning.

Thus, if the behavior detecting means 34 detects the behavior of the waist or the knee while the second momentum detecting means 32 is indicating the negative momentum (i.e., back swing), it can be judged that at least a body turn is being made. However, if the behavior detecting means 34 detects the behavior of the waist or the knee while the second momentum detecting means 32 is indicating zero momentum (i.e., substantially the top position) or positive momentum (i.e., from the down swing to the follow-through), it can be judged that the timing of moving the waist and the knees is too late to form a body turn. The judging means 36 indicates the result of judgment by speech, for instance "O.K.", "Body turn O.K.", etc. or conversely "N.G.", "Wrong timing", etc. Alternatively, the result of judgment may be displayed by the generation of sound or no sound. As a further alternative, it may be indicated optically. Further, the judging means 36 may include a liquid crystal display for indicating the judgment result.

This golf swing training device 30 comprising the second momentum detecting means 32, behavior detecting means 34 and the judging means 36, may be combined with the previous embodiments.

Figure 7:
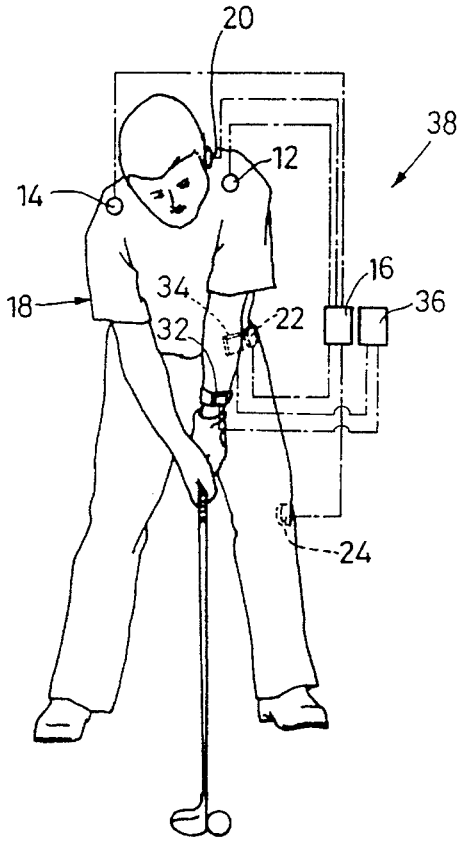

For example, as shown in FIG. 7, it is possible to construct a golf swing training device 38 with detecting means 12 mounted on the left shoulder at a predetermined position thereof, second detecting means 14 mounted on the right shoulder at a predetermined position thereof, an earphone 20 for informing the golfer 18 of the content of detection by the detecting means 12 and second detecting means 14 via the controller 16, to-waist and to-knee transmitting means 22 and 24 for transmitting information to the golfer's waist and knee, respectively, second momentum detecting means 32, behavior detecting means 34 and judging means 36. With the golf swing training device 38 having such a structure, first at the time of the back swing the detecting means 12 detects the contact of the shoulder and the chin with each other or the closest approach of the two to each other and transmits a detection signal to the earphone 20 and to-waist and to-knee transmitting means 22 and 24. When the golfer turns the waist and knees in response to this signal, the behavior detecting means 34 detects the movement and transmits the signal to the judging means 36. At this time, since the back swing is in force, the momentum detecting means 32 indicates that the momentum is negative, and transmits the corresponding signal to the judging means 36.

At this time, if the second momentum detecting means 32 detects zero or positive momentum, the judging means 36 provides an error message.

After detecting the motion of the waist or the knee by the behavior detecting means 34, with a predetermined time delay the second momentum detecting means 32 detects zero momentum (top) and then positive momentum (from down swing to follow-through). When the second detecting means 14 detects the contact of the right shoulder and the chin with each other while positive momentum is shown, the judging means 34 indicates that the golf swing and the swing form are right.

In such embodiment, the controller 16 and judging means 36 may be made unitedly each other. Further, the behavior detecting means 34 and to-waist or to-knee transmitting means 22 or 24 may be made unitedly each other. The momentum detecting means 28 and the second momentum detecting means 32 may be constituted of the same unit. Or even if these means are differently operable, they may be made unitedly.

Figure 8:
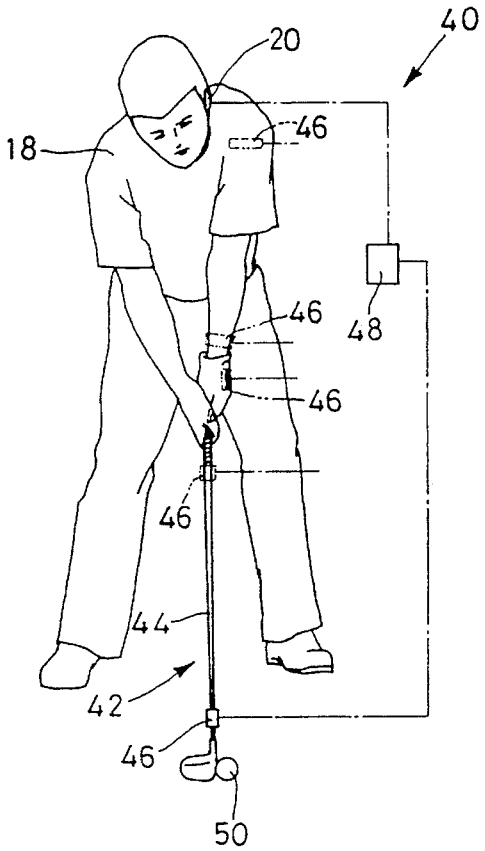
FIG. 8 is a view showing a further structure of the golf swing training device according to the invention.

FIG. 8 shows a further embodiment of the golf swing training device according to the invention. This device comprises detecting means mounted on the shaft 44 of the golf club 42, and an earphone (notifying means) 20 for informing the golfer 18 of the movement of the end of the golf club 42 as detected by the detecting means 46 via a controller 48.

Figure 9:
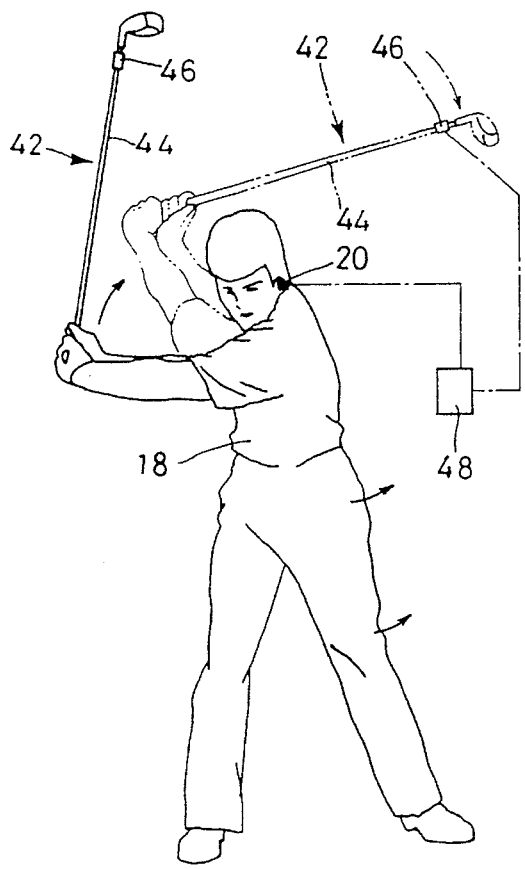
FIG. 9 is a view for explaining the operation of the golf swing training device shown in FIG. 8.

When the golfer 18 gets into the back swing as shown in FIG. 9, the detecting means 46 detects or measures the motion of the golf club 42 at least from the address position as shown in FIG. 8 to the top position as shown by phantom lines in FIG. 9, that is, the speed, acceleration, momentum, centrifugal force, etc. of the golf club 42. The speed at each position during the back swing is thus detected continuously or intermittently. Where it is mounted on the end of the golf club 42, the detecting means 46 is constructed such as to have low weight lest its balance should be changed greatly and that it will not be damaged by a shock produced at the time of the impact of the ball 50. As the detecting means 46, a speed sensor is most suitable. If there is no available sensor that can be used, it is possible to measure the acceleration, momentum, centrifugal force, etc. obtainable as a function of the speed and covert the detected value to the speed. For example, it is possible to use a pressure-sensitive sensor, a pressure sensor, a weight sensor, etc. which detect changes in pressure, current, etc., no limitation being imposed on the type of sensor. The data obtained by such detecting means 46 need not have a quantitatively accurate value but is sufficiently qualitative.

The earphone 20 informs the golfer 18 of the continuously changing speed of the golf club 42 during the back swing as detected by the detecting means 46 via the controller 48.

More specifically, the detecting means 46 detects the speed of the golf club 42 at the time of the back swing, and the controller 48 converts the detected speed to corresponding sound volume, discontinuous sound interval, sound tone, etc. and the converted information is informed to the golfer 18 by the earphone 20. Meanwhile, the golfer 18 can sense the operating position of the golf club 42 by his or her own sense, while he or she is informed of the speed of the golf club 42 at the operating position by the earphone 20.

Thus, when the golfer 18 gets into the back swing from the address, he or she can hear a low level sound or discontinuous sound at a coarse generation interval from the earphone 20 which has previously been producing no sound, thus grasping the acceleration state. As the top is approached in the back swing, the level of the sound that is heard is gradually increased, or the interval of the discontinuous sound is gradually reduced. Or, some of a certain number of, for instance five, different sounds are heard. Further, near the top the highest level sound or shortest interval discontinuous sound is heard, or higher level one of the five different level sounds are heard. When such sounds are heard, the golfer can recognize that the back swing that was made was ideal. On the contrary, if the sounds that are heard from the earphone 20 during the back swing contain a level change from a higher to a lower level sound or a change from a shorter to a longer discontinuous sound interval or a sudden sound change, it indicates that the back swing is not stable or ideal, and the golfer 18 thus recognizes that the way of swing was bad. It is thus possible to immediately correct the back swing form. The sound level may vary with the golfer, and the maximum speed, i.e., the maximum sound level, varies with the golfer.

With the golf swing training device 40 having the above structure, as shown in FIG. 8, the detecting means 46 is mounted on the shaft 44 of the golf club 42, the earphone 20 is mounted in an ear, and the controller 48 is mounted around the waist by means of a belt or the like. Thus, the preparations are completed. Then, as shown in FIG. 9, the golfer 18 with the golf club 42 gets into the back swing from the address and twists the body clockwise about the backbone, thus turning the golf club 42 together with the arms. At this time, the detecting means 46 detects the rotation speed of the golf club 42, and the earphone 20 informs the golfer 18 of the speed change by sound or speech. When the golfer 18 senses that the top position is reached by the golf club 42, with a predetermined time difference and by a reflex he or she intuitively causes the left waist and the left knee substantially and simultaneously to slide in the flying direction of the ball and begin to turn counterclockwise for the down swing. At this time, the golfer 18 can check through the earphone 20 whether the rotation speed of the golf club 42 was highest near the top and the back swing was ideal.

At this moment, the lower body is caused to slide several centimeters toward the target and be twisted counterclockwise, while the upper body is twisted by the momentum continually toward the top position, therefore, the body is twisted and the shaft flexes. Thus, after the upper body stops the clockwise twisting by being pulled with the lead of the lower body, with the body muscles as a spring and under the principles of the lever, the upper body turns to be twisted counterclockwise. The golfer thus gets into the down swing. By making such a body turn swing, the down swing can be made with the body muscles to obtain a high head speed for hitting the ball. The ideal down swing with the lead of the lower body is made more perfect by causing the shaft to flex at the top with the ideal back swing.

Figure 10:
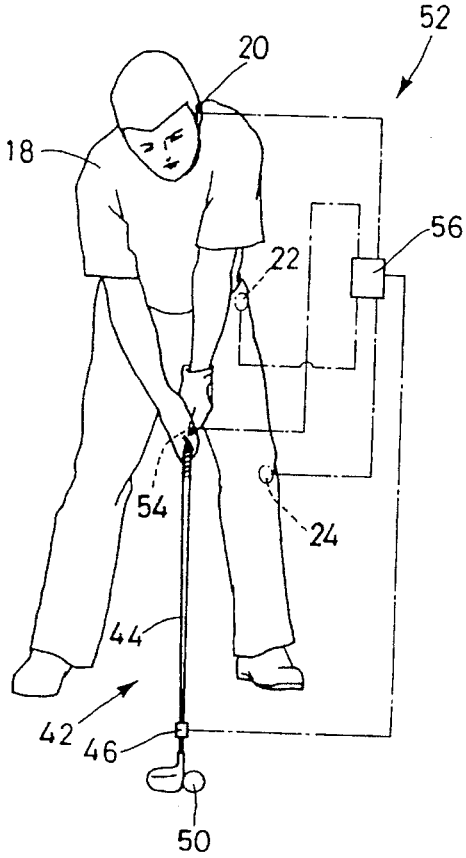
FIG. 10 is a view showing a further structure of the golf swing training device according to the invention.

FIG. 10 shows a further embodiment of the golf swing training device 52 according to the invention. This device comprises at least detecting means 46 for detecting the rotation speed or speed change of the golf club 42 during the back swing, pressure detecting means 54 for detecting the pressure between the golfer's left thumb and the grip of the golf club 42, an earphone (notifying means) 20 for informing the golfer 18 of the speed and pressure changes detected by the detecting means 46 and pressure detecting means 54 via a controller 56 and to-waist and to-knee transmitting means 22 and 24 for transmitting the timing of causing the sliding in the flying direction and turning of the waist and the knees.

Figure 12:
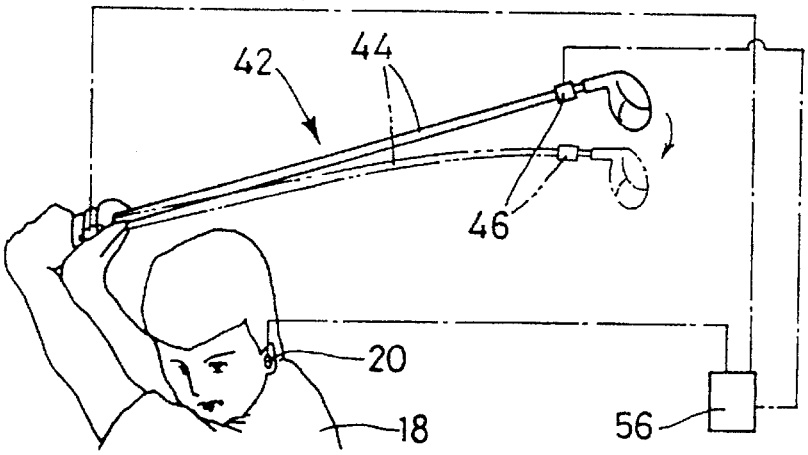
FIG. 12 is a fragmentary enlarged-scale view for explaining the operation of the golf swing training device shown in FIG. 10.

As shown in FIG. 12, at the time of the back swing from a position of the golf club 42 right before reaching the top (i.e., a position corresponding to about 80 to 90% of the back swing), that is, a position near which the rotation of the arms or wrists is stopped with the twisting of the body (with the golf club 42 shown by solid lines), till the golf club 42 is stopped (with the golf club 42 shown by phantom lines), the golf club 42 flexes due to great momentum acting thereon. At this time, a high pressure is generated between the contact portions of the left thumb of the golfer 18 and the grip of the golf club 42. The pressure detecting means 54 detects this pressure.

Figure 11:
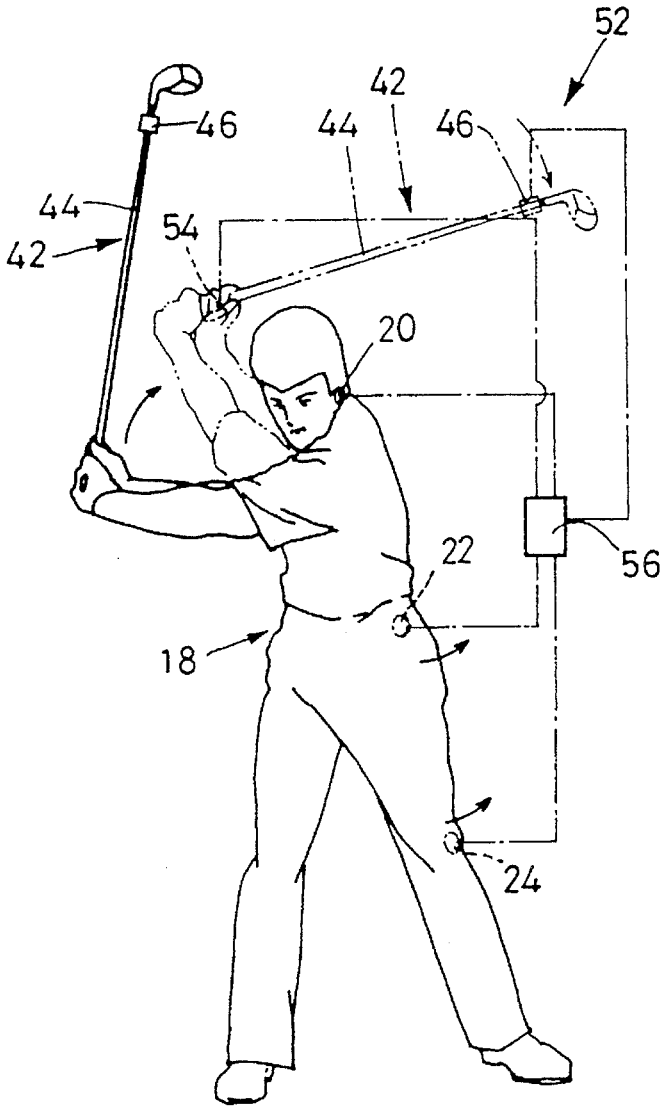
FIG. 11 is a view for explaining the operation of the golf swing training device shown in FIG. 10.

With the golf swing training device 52 having such a structure, as shown in FIG. 10, the detecting means 46 is mounted on the end of the shaft 44 of the golf club 2, the pressure detecting means 54 is mounted on the inner side of the left thumb, the earphone 20 is mounted in an ear, the to-waist and to-knee transmitting means 22 and 24 are mounted on the left waist and the left knee, respectively, and the controller 56 is mounted around the waist by means of a belt or the like. Thus, the preparations are completed. Then, as shown in FIGS. 10 and 11, the golfer 18 with the golf club 42 first gets into the back swing from the address and twists the body about the backbone clockwise. With this operation of the back swing, the detecting means 46 detects the rotation speed of the golf club 42. Thus, the earphone 20 informs the golfer 18 of the speech or the like corresponding to the detected speed via the controller 56. Thus, the golfer 18 can instantly check whether the back swing that was made was ideal.

Meanwhile, when the golfer 18 twists the body clockwise in the back swing, his or her twisting is stopped at a position near an instant when the left shoulder is brought into contact with the left hand of the chin (i.e., a position corresponding to about 80 to 90% back swing), while the golf club 42 is going to be turned continually. Thus, the pressure detecting means 54 provided on the inner side of the left thumb is greatly pressed to detect the pressure. Thus, the pressure detecting means 54 detects that the golf club 42 has approached the top position. As a result, the earphone 20 informs the golfer 18 by sound or speech of approaching the top via the controller 56, and also the to-waist and to-knee transmitting means 22 and 24 transmit the start of operation to the waist and knee. Thus, with a predetermined time difference and by a reflex the golfer 18 intuitively, substantially and simultaneously can cause the left knee and the left waist to slide in the flying direction of the ball and begin to turn clockwise. It is thus possible as in the previous case to make an ideal down swing with body turn.

In such a golf swing training device 51, depending on the degree of mastering the swing form it is possible to remove either one or both of the to-waist and to-knee transmitting means 22 and 24 and train the golf swing with the pressure detecting means 54, controller 56 and earphone 20.

While in the above embodiment the detecting means 46 has been mounted on the end of the shaft 44 of the golf club 42, although the obtained data have large values, the shock produced when the golf ball 50 is hit is readily transmitted to the detecting means 46. Therefore, there is a possibility of damaging the detecting means 46. Besides, the weight of the head of the golf club 42 is increased, and it is possible for the club 42 to get out of balance. Accordingly, the detecting means 46 may be provided on a central portion of the shaft 44 or on the grip as shown in FIG. 8, and it may suitably mounted on the golfer's hand or arm or upper body, particularly a shoulder. Further, it is possible to mount not only one but a plurality of detecting means 46.

As a further embodiment, it is possible to use a flute or a tool for producing air-cutting sound in lieu of the detecting means 46, notifying means 20 and controller 48. Specifically, a flute may be provided on the golf club 42 at an adequate position thereof such that when the golf club 42 is swung, the flute generates a sound with the tone or volume varying according to the swing speed, thus permitting judgment according to the sound tone or volume as to whether the back swing is adequate. Instead of the flute, it is possible to provide a structure such that air-cutting sound can be readily produced when the golf club 42 is swung.

In the above embodiments, the detecting means 12, second detecting means 14, detecting means 46, pressure detecting means 54, notifying means such as the earphone 20, and to-waist and to-knee transmitting means 22 and 24 may be wired with leads for transmitting information. Alternatively, it is possible to permit transmission of information on radio waves. Likewise, it is possible to permit signal transmission on radio waves between the pressure detecting means 54 and controller 56.

Figure 13:
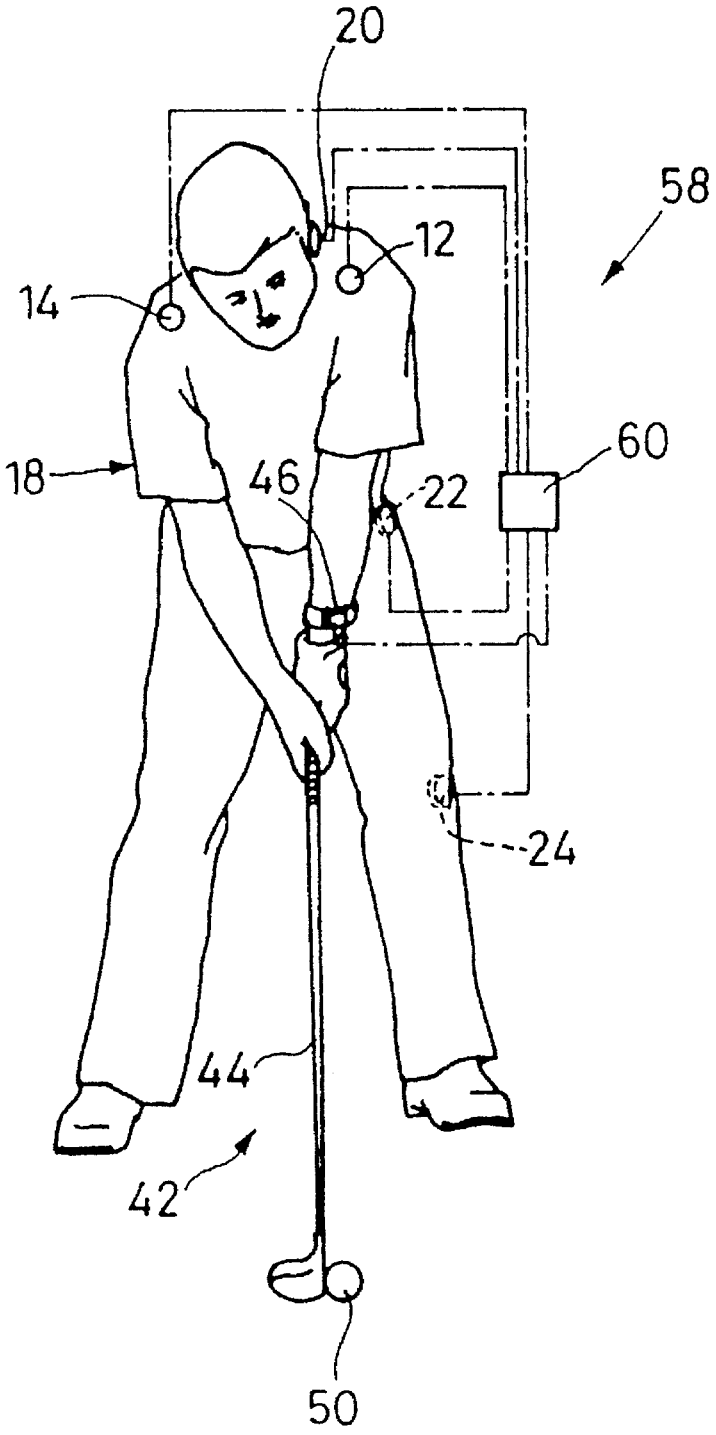
FIG. 13 is a view showing a further structure of the golf swing training device according to the invention.

It is possible to suitably combine the above embodiments of the golf swing training device according to the invention. For example, a golf swing training device 58 as shown in FIG. 13 may comprise detecting means 12, earphone (notifying means) 20, to-waist and to-knee transmitting means 22 and 24, detecting means 46 and controller 60.

When using the golf swing training device 58 having such structure, the golfer first gets into the back swing from the address and twist the body clockwise about the backbone while turning the golf club 42 together with the arms. At this time, the detecting means 46 mounted on an arm of the golfer 18 detects the rotation speed of the arms, i.e., the golf club 42, and the earphone 20 informs the golfer 18 of the speed change as sound or speech. When the golf club 42 approaches the top position, the detecting means 12 detects the contact or closest approach of the chin and a shoulder and transmits a detection signal to the earphone 20 and the to-waist and to-knee transmitting means 22 and 24. In response to the detection signal, the golfer 18 immediately or with a predetermined time difference and by a reflex intuitively, substantially and simultaneously causes the left knee and the left waist to slide slightly in the flying direction of the ball and begin to turn counterclockwise. At this time, the golfer 18 can check via the earphone 20 whether the rotation speed of the golf club 42 was highest near the top, thus producing an ideal back swing.

By making this body turn swing, the down swing can be obtained with the body muscles, thus obtaining a high head speed to hit the ball 50. Then, when the golfer gets into the follow-through, he or she can confirm a good swing with the right shoulder in contact with the right side of the chin. Subsequently, the body weight is pulled by the momentum of the club and naturally shifted to the left foot. The finish is thus determined. At this time, the second detecting means 14 detects the contact of the right shoulder and the chin, and the earphone 20 informs that the swing form was right.

As shown above, it is possible to suitably combine the above embodiments of the golf swing training device according to the invention without any particular limitation imposed on the combination.

The golf swing training device according to the invention is of course applicable to the left hand golfer as well. In this case, it is of course that the left and right sides are reversed in the above description.

Further, the controllers 16, 48 and 56 suitably include batteries or amplifiers for the above operation, and the detecting means 46, pressure detecting means 54 and to-waist and to-knee transmitting means 22 and 24 are suitably capable of being removably bonded to predetermined positions using double side adhesive tapes or double side fasteners. Further, it is possible to suitably combine the above embodiments. Further, various changes and modifications of the embodiments of the invention may be made without departing from the scope and spirit of the invention and on the basis of the knowledge of a person having ordinary knowledge in the art.

FIELD OF THE INDUSTRIAL UTILIZATION

As has been described in the foregoing, the golf swing training device according to the invention can be utilized in golf teaching rooms, golf training places and further empty lots permitting the golf training. The device may be used for business purpose with instructors or used by individuals.

I claim:

1. A golf swing training device, comprising:

detecting means for detecting that one of the shoulders of a golfer is in contact with or closest to the chin when the golfer has gotten into the back swing from the address position, notifying means for notifying the contact or closest approach detected by said detecting means to the golfer via a controller by a sound or speech, transmitting means for transmitting signals selected from the group consisting of electric currents, mechanical vibrations and sound waves indicating the contact or closest approach detected by said detecting means to the golfer's knee and/or waist on the side of the pivoting foot after weight shift.

2. A golf swing training device, comprising:

momentum detecting means mounted on a golfer's arm or the golf club or at least either one of the contact portions of the golfer's hand or fingers and the golf club for detecting a change in the momentum slightly before the top at the time of the back swing, notifying means for notifying a change in the momentum detected by said momentum detecting means to the golfer via a controller by a sound or speech, and transmitting means for transmitting signals selected from the group consisting of electric currents, mechanical vibrations and sound waves indicating a change in the momentum detected by said detecting means to the golfer's knee or waist on the side of the pivoting foot after weight shift.

3. A golf swing training device according to claim 1 or 2, which further comprises second detecting means for detecting that the golfer's other shoulder is in contact with or closest to the chin when the golfer has gotten into the follow-through after the down swing, and notifying means for notifying the contact or closest approach detected by said detecting means to the golfer via a controller.

4. A golf swing training device, comprising:

detecting means for detecting that one of golfer's shoulders is in contact with or closest to the chin when the golfer has gotten into the back swing from the address position, a controller which receives signals from said detecting means, and transmitting means for transmitting signals selected from the group consisting of electric currents, mechanical vibrations and sound waves indicating the contact or closest approach detected by said detecting means to the golfer's knee and/or waist on the side of the pivoting foot after weight shift via said controller.

5. The golf swing training device according to claim 1 or 4, further comprising second momentum detecting means mounted on a golfer's arm or the golf club for detecting the momentum at the time of the back swing or the momentum from the down swing to the follow-through, behavior detecting means mounted on the golfer's knee and/or waist on the side of the pivoting foot after weight shift for detecting a movement of the knee and/or waist, and judging means for judging a timing according to the detection signals of said second momentum detecting means and behavior detecting means.

6. The golf swing training device according to claim 1, further comprising detecting means mounted on at least either one of the golfer's hand and upper body and the golf club for detecting the movement of the mounting spot while a swing is made at least from the address position through the back swing to the top, and notifying means for notifying a change in the movement detected by the detecting means to the golfer.

7. The golf swing training device according to claim 1, further comprising detecting means mounted on at least either one of the golfer's hand and upper body and the golf club for detecting the movement of the mounting spot, storage means for continuously or intermittently storing the movement detected by said detecting means, and display means for reproducing and displaying the movement stored in said storage means.

8. The golf swing training means according to one of claims 6 and 7, wherein the movement of the hand, arm or golf club detected by said detecting means is at least either one of the speed, acceleration, momentum and centrifugal force.

9. A golf swing training device, comprising:

momentum detecting means mounted on one of a golfer's arm and a golf club, and either one of the contact portions of the golfer's hand or fingers and the golf club for detecting a change in the momentum before the golfer reaches the top at the time of the back swing, and transmitting means for transmitting signals selected from the group consisting of electric currents, mechanical vibrations and sound waves indicating a change in the momentum detected by said momentum detecting means to the golfer's knee and/or waist on the side of the pivoting foot after weight shift.

10. A golf swing training device, comprising:

pressure detecting means provided on at least either one of contact portions of the golfer's thumb and the golf club grip in contact with the thumb for detecting the pressure between the thumb and the contact portion, and transmitting means for transmitting signals selected from the group consisting of electric currents, mechanical vibrations and sound waves indicating the pressure, when detected by said pressure detecting means, to the golfer's knee and/or waste on the side of the pivoting foot after weight shift.

* * * * *